US008784032B1

(12) United States Patent
Magdaleno

(10) Patent No.: US 8,784,032 B1
(45) Date of Patent: Jul. 22, 2014

(54) ACCESSORY ARM TO HELP MAINTAIN A CLOSE LID ON TRASH RECEPTACLES

(76) Inventor: Camilo M. Magdaleno, Moorpark, CA (US)

( * ) Notice: Subject to any disclaimer, the term of this patent is extended or adjusted under 35 U.S.C. 154(b) by 769 days.

(21) Appl. No.: 12/977,871

(22) Filed: Dec. 23, 2010

(51) Int. Cl.
*B65F 3/04* (2006.01)
*B65D 43/24* (2006.01)

(52) U.S. Cl.
USPC ..... 414/406; 414/407; 220/381; 292/288; 292/289

(58) Field of Classification Search
USPC ..... 220/315, 318, 324, 326–328, 831–833, 220/908; 292/87, 108, 258, 288, 289, 292/DIG. 17, DIG. 38; 414/408, 409, 411, 414/414, 406, 407
See application file for complete search history.

(56) References Cited

U.S. PATENT DOCUMENTS

| | | | | | |
|---|---|---|---|---|---|
| 1,985,587 | A | * | 12/1934 | Storrs, Jr. | 220/326 |
| 3,138,275 | A | * | 6/1964 | Dempster et al. | 414/408 |
| 3,334,932 | A | * | 8/1967 | Buresh | 292/87 |
| 3,527,356 | A | | 9/1970 | Nerdy | |
| 5,028,196 | A | | 7/1991 | Richards | |
| 5,042,856 | A | | 8/1991 | Goodman | |
| 5,209,533 | A | * | 5/1993 | Menard | 292/288 |
| 5,224,743 | A | | 7/1993 | Dawdy et al. | |
| 5,595,317 | A | * | 1/1997 | Hodge | 220/831 |
| 5,829,426 | A | * | 11/1998 | Cloutier | 126/41 R |
| 6,027,300 | A | | 2/2000 | Richards | |
| 6,448,898 | B1 | * | 9/2002 | Kasik | 340/686.1 |
| D583,120 | S | | 12/2008 | Arthurson | |
| 2003/0160057 | A1 | * | 8/2003 | Johansen | 220/835 |

* cited by examiner

*Primary Examiner* — Fenn Mathew
*Assistant Examiner* — James N Smalley

(57) ABSTRACT

The present invention features a receptacle lift arm 100 that can maintain the receptacle lid closed after the receptacle is picked up and the contents there in are dumped.

2 Claims, 4 Drawing Sheets

TOP VIEW

SIDE VIEW

ACCESSORY ARM TO HELP MAINTAIN A CLOSE LID ON TRASH RECEPTACLES

BACKGROUND OF THE INVENTION

The present invention features an accessory arm to help maintain a close lid on trash receptacles after the receptacles have been emptied by dump trucks.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
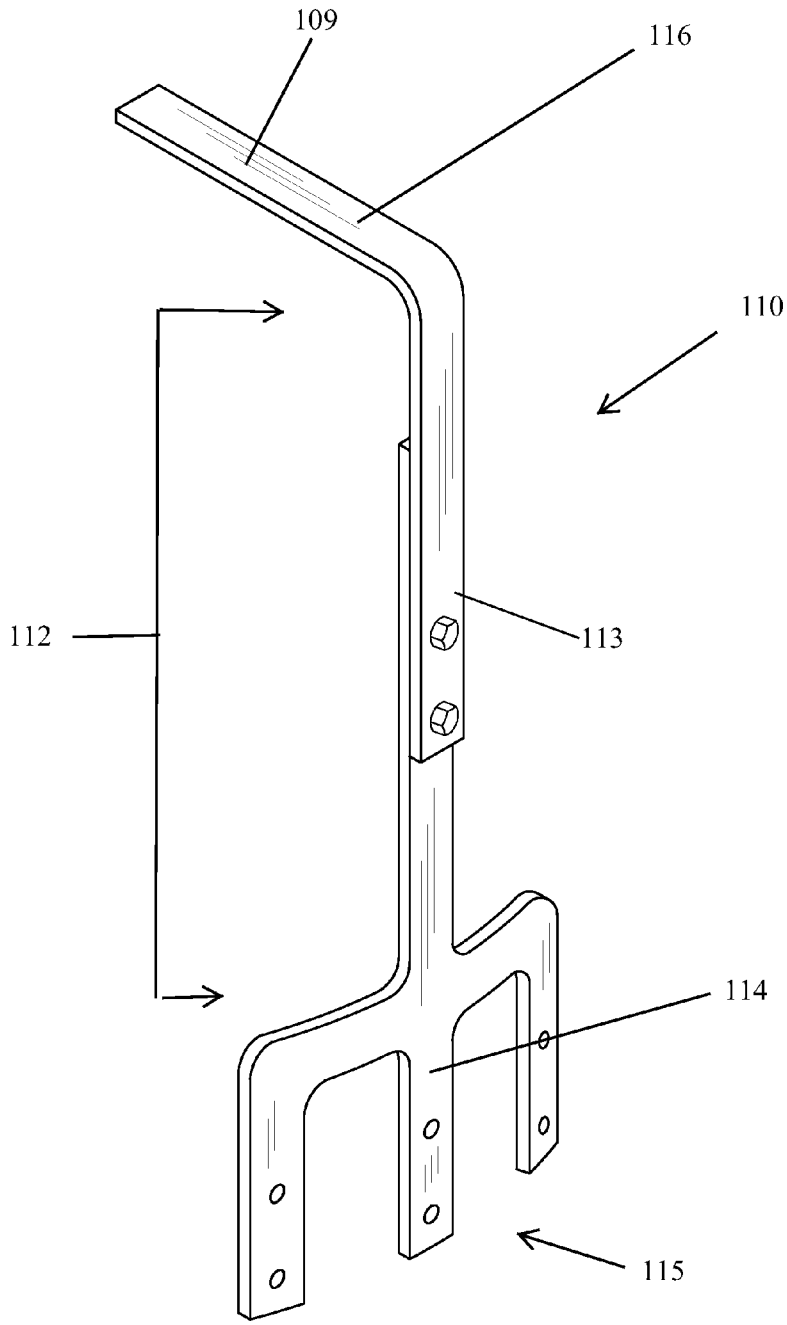
FIG. 1 shows a perspective view of an accessory arm of the receptacle lift arm.
Figure 2:
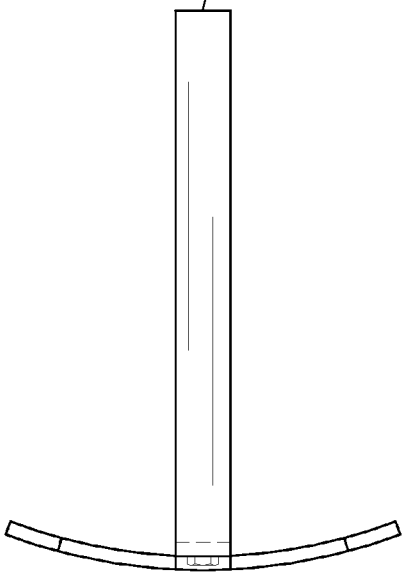
FIG. 2 shows a top view of the accessory arm.
Figure 3:
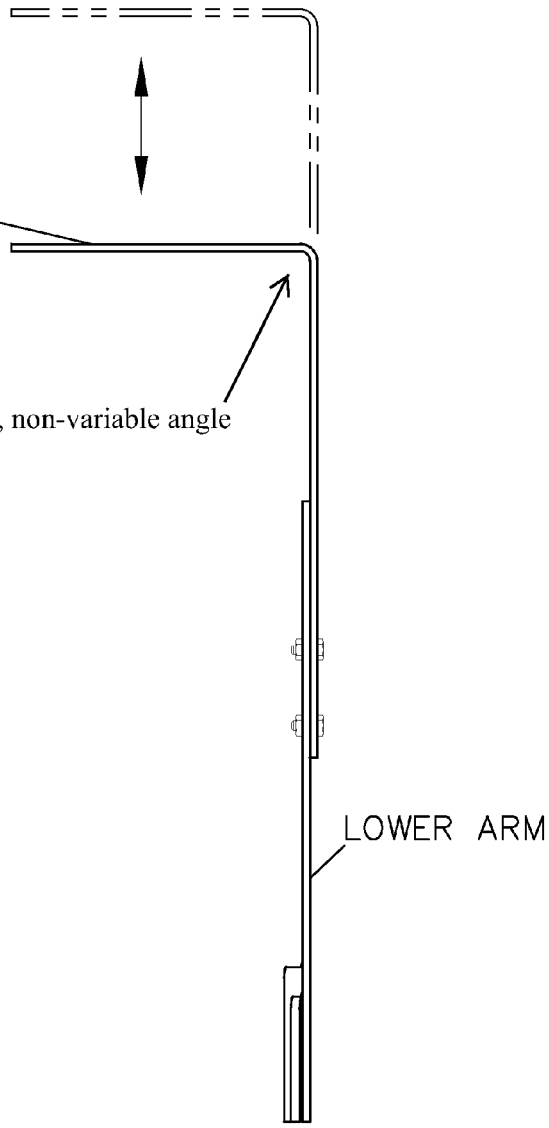
FIG. 3 shows a side view of the accessory arm.
Figure 4:
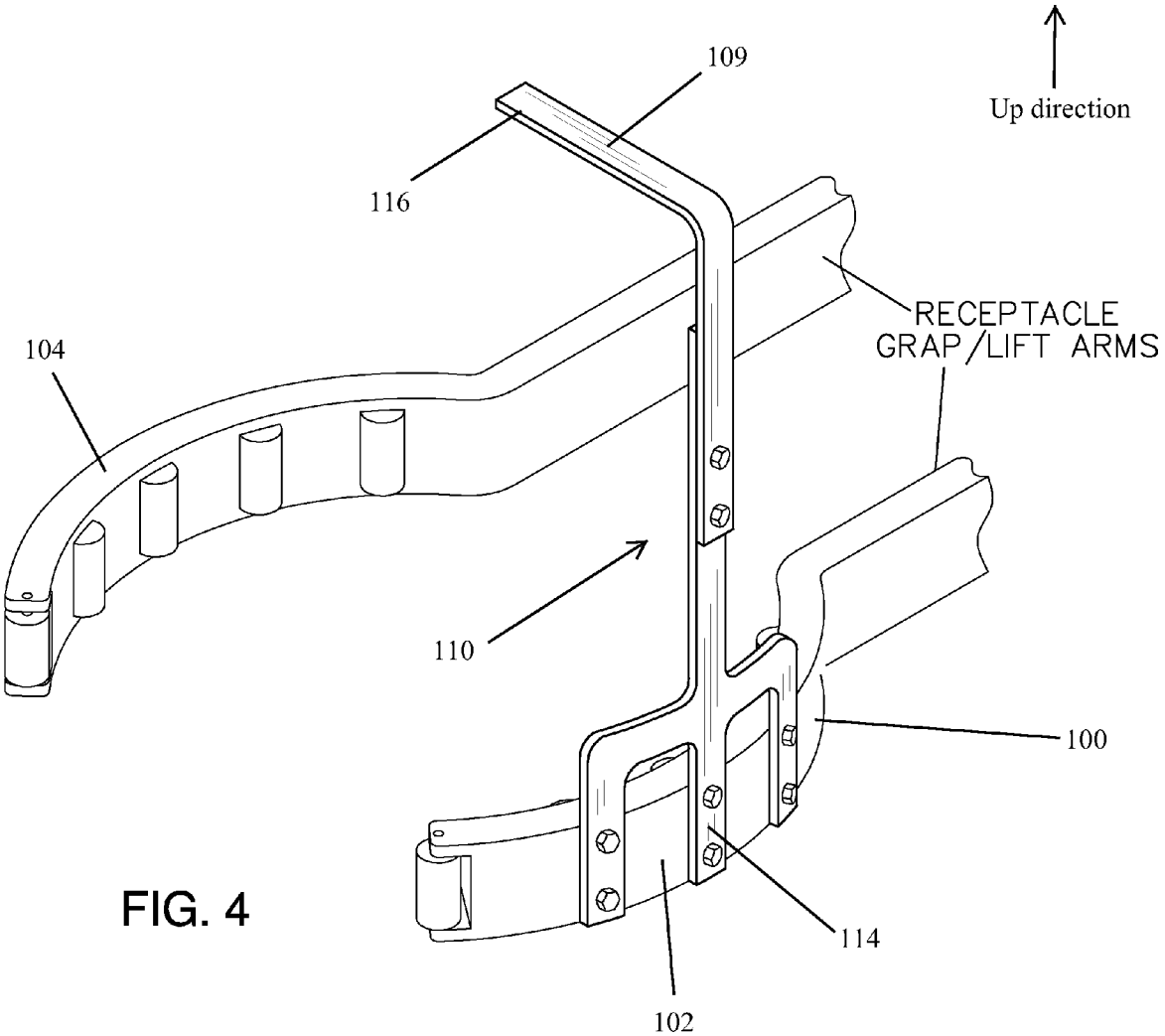
FIG. 4 shows a perspective view of the receptacle lift arm with an accessory arm attached.

Referring now to FIG. 1-5, the present invention features a receptacle lift arm 100 that can maintain the receptacle lid closed after the receptacle is picked up and the contents there in are dumped.

In some embodiments, the lift arm 100 comprises an accessory arm 110 that helps maintain a lid 120 closed on a receptacle 130. The accessory arm 110 has a shaft portion 112, a first end 114 and a second end 116. The first end 114 secures to a portion of the receptacle arm that wraps around the receptacle 102. The second end 116 extends upward above the receptacle lift arm 100 and permanently bends toward a direction of a second receptacle lift arm 104 to form a bent portion 109, see FIG. 4. In some embodiments, the angle between the bent portion 109 and the shaft portion 112 is fixed and is not variable.

Figure 5:
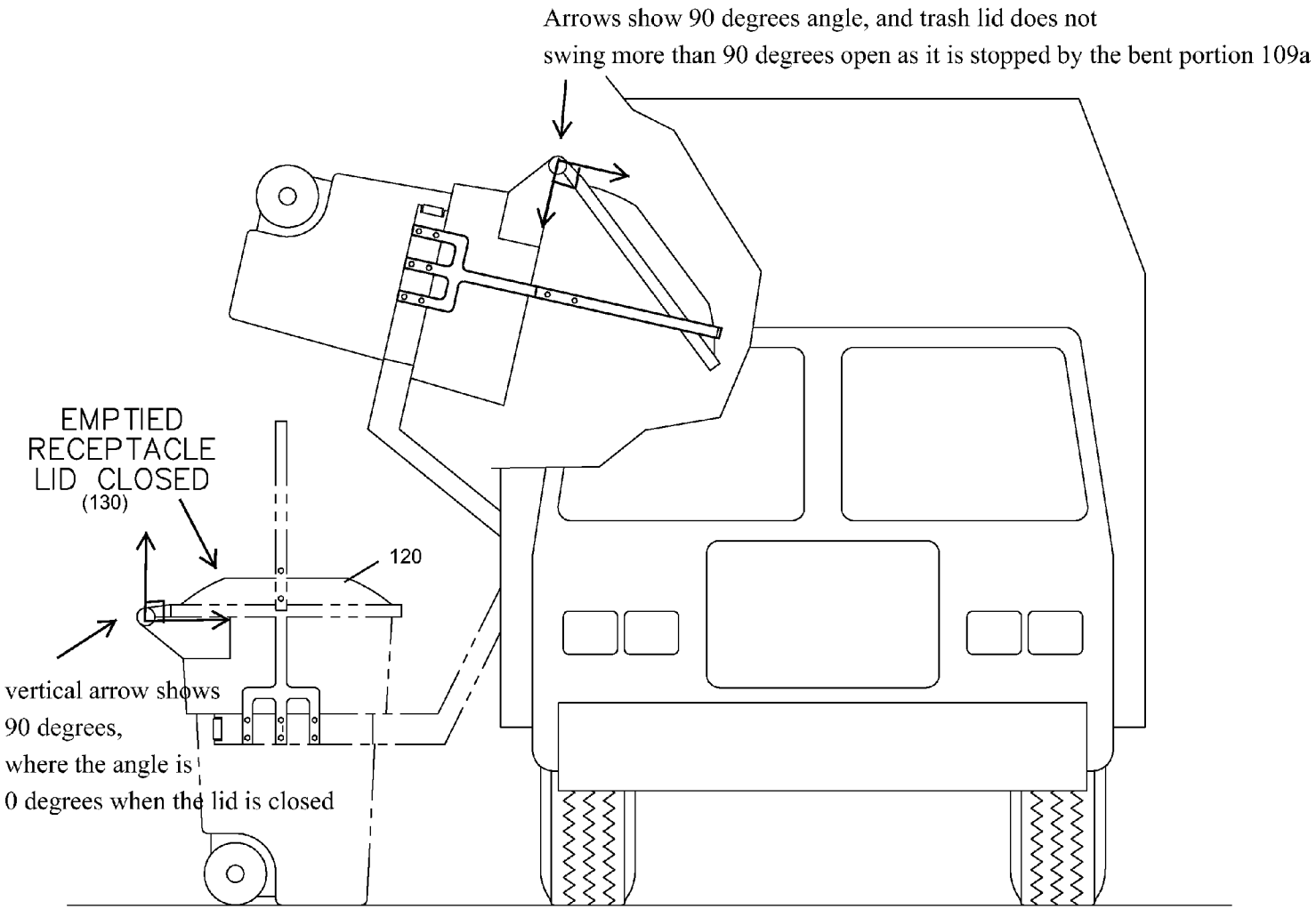
FIG. 5 shows the emptying process of the receptacle, wherein the lid is being kept at opening at a less than 90 degrees angle when the receptacle is being dumped, and wherein the lid falls back to its closed position when the receptacle is lowered back to the ground.

The bent portion 109 functions to prevent the lid 120 from opening more than 90 degrees, by hooking over the lid 120 when it is swung open during the emptying process, see FIG. 5. When the receptacle is flatly sitting on the ground and the lid is closed, the lid is at a zero degree angle. When it is opened straight up, the lid is opened at a 90 degrees angle, see FIG. 5. In FIG. 5, the lid is opened at about a 45 degrees angle as it is hooked in by the bent portion 109. When the lid 120 is prevented from opening at more than 90 degrees when the receptacle is being emptied, the lid 120 can naturally fall back to its closed position when the receptacle is lowered back to the ground.

In some embodiments, the shaft portion 112 can be shortened or lengthened. For example, the shaft portion 112 may comprise a first section 113 connected to a second section 114, and are connected to each other at various locations to provide for various length. The shaft portion 112 may be of any appropriate length to allow the bent portion 109 to hover at the appropriate height over the receptacle to stop the lid from swinging more than 90 degrees during the emptying process. One of ordinary skill could readily determine the length of the portion 112 in light of the present disclosure.

In some embodiments, the first end 114 has three prongs 115 that attaches to the receptacle lift arm 100. The three prongs can provide for a more stable hold of the shaft.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A receptacle lift arm (100) comprising:

an accessory arm (110) that helps maintain a lid (120) closed on a receptacle (130), the accessory arm (110) has a shaft portion (112), a first end (114) and a second end (116), the first end (114) secures to a portion of the receptacle arm that wraps around the receptacle (102), the second end (116) extends upward above the receptacle lift arm (100) and permanently bends toward a direction of a second receptacle lift arm (104), wherein the first end (114) has three prong fork (115) that attaches to the receptacle lift arm (100);

the bent portion functions to prevent the lid (120) from opening more than 90 degrees, by hooking over the lid (120) when it is swung open.

2. An accessory arm (110) that helps maintain a lid (120) closed on a receptacle( 130), the accessory arm (110) has a shaft portion (112), a first end (114) and a second end (116), the first end (114) secures to a portion of the receptacle arm that wraps around the receptacle (102), the second end (116) extends upward above the receptacle lift arm (100) and permanently bends toward a direction of a second receptacle lift arm (104), the bent portion functions to prevent the lid (120) from opening more than 90 degrees, by hooking over the lid (120) when it is swung open, wherein the first end (114) has three prong fork (115) that attaches to the receptacle lift arm (100).

* * * * *